US007733158B2

(12) United States Patent
Huang et al.

(10) Patent No.: US 7,733,158 B2
(45) Date of Patent: Jun. 8, 2010

(54) TRIM FUSE CIRCUIT CAPABLE OF DISPOSING TRIM CONDUCTING PADS ON SCRIBE LINES OF WAFER

(75) Inventors: Chao-Hsing Huang, Hsinchu (TW); Chun-Liang Yeh, Taipei (TW)

(73) Assignee: Advanced Analog Technology, Inc., Hsinchu (TW)

( * ) Notice: Subject to any disclaimer, the term of this patent is extended or adjusted under 35 U.S.C. 154(b) by 0 days.

(21) Appl. No.: 12/277,313

(22) Filed: Nov. 25, 2008

(65) Prior Publication Data

US 2010/0085107 A1 Apr. 8, 2010

(30) Foreign Application Priority Data

Oct. 3, 2008 (TW) ..... 97138087 A

(51) Int. Cl.
*H01H 85/00* (2006.01)

(52) U.S. Cl. ..... 327/525

(58) Field of Classification Search ..... 327/524, 327/525, 564, 565

See application file for complete search history.

(56) References Cited

U.S. PATENT DOCUMENTS 6,255,893 B1 * 7/2001 Dishongh et al. ..... 327/525
6,462,609 B2 * 10/2002 Hashimoto et al. ..... 327/525
7,420,407 B2 * 9/2008 Kim ..... 327/525
7,429,886 B2 * 9/2008 Huang et al. ..... 327/525

* cited by examiner

*Primary Examiner*—Jeffrey S Zweizig
(74) *Attorney, Agent, or Firm*—Winston Hsu

(57) ABSTRACT

A trim fuse circuit includes a metal fuse, a trim pad coupled to the first end of the metal fuse, a first transistor coupled to the first end of the metal fuse, a second transistor coupled to the second end of the metal fuse, an inverter coupled to the second end of the metal fuse, a switch coupled to the second end of the metal fuse, and a common trim pad coupled to the control end of the switch. The inverter outputs a data signal according to the status of the metal fuse. The trim pad can be disposed on the scribe line of a wafer. When the trim pad is cut and accordingly connects to the substrate of the wafer, the data signal is not affected.

11 Claims, 11 Drawing Sheets

TRIM FUSE CIRCUIT CAPABLE OF DISPOSING TRIM CONDUCTING PADS ON SCRIBE LINES OF WAFER

BACKGROUND OF THE INVENTION

1. Field of the Invention

The present invention relates to a trim fuse circuit, and more particularly, to a trim fuse circuit capable of disposing trim conducting pads on scribe lines of a wafer.

2. Description of the Prior Art

Please refer to FIG. 1. FIG. 1 is a diagram illustrating a voltage reference circuit 100. The voltage reference circuit 100 is utilized to generate a reference voltage $V_{REF}$ with a magnitude decided by the reference circuit 100. As shown in FIG. 1, the voltage reference circuit 100 comprises a constant current source $I_{REF}$, five resistors $R_1$, $R_2$, $R_3$, $R_4$, and $R_5$, and four switches $SW_1$, $SW_2$, $SW_3$ and $SW_4$. The current generated by the constant current source $I_{REF}$ is set as 1 micro-Amp and the five resistors $R_1$~$R_5$ are all set as 1 mega-ohm. The switches $SW_1$~$SW_4$ respectively short out the corresponding resistors according to the switch control signals $S_1$~$S_4$. If the switch control signal is logic "0" (low voltage level), the switch is turned off. On the contrary, if the switch control signal is logic "1" (high voltage level), the switch is turned on and the corresponding resistor is short-circuited. For example, when switch control signal $S_1$ is logic "0", the switch $SW_1$ is turned off so that the current from the constant current source $I_{REF}$ passes through the resistor $R_1$ and a voltage drop over the resistor $R_1$ is generated. When switch control signal $S_1$ is logic "1", the switch $SW_1$ is turned on so that the current from the constant current source $I_{REF}$ passes through the switch $SW_1$ and no voltage drop is generated. As shown in FIG. 1, when the switch control signals $S_1$~$S_4$ are set as [1111], the switches $SW_1$~$SW_4$ are turned on so that the generated reference voltage $V_{REF}$ is 1 volt ($V_{REF}=I_{REF}\times R_5=1\times1=1$). When the switch control signals $S_1$~$S_4$ are set as [1110], the switches $SW_1$~$SW_3$ are turned on and the switch $SW_4$ is turned off. Consequently, the generated reference voltage $V_{REF}$ is 2 volts ($V_{REF}=I_{REF}\times(R_4+R_5)=1\times2=2$) and so on. Therefore, the reference voltage $V_{REF}$ can be adjusted as required according to the switch control signals $S_1$~$S_4$.

Please refer to FIG. 2. FIG. 2 is a diagram illustrating a conventional trim fuse circuit 200. The trim fuse circuit 200 is utilized for generating the switch control signals $S_1$~$S_4$. The user can set the status of the trim circuit 200 in order to set the logic (voltage level) of the switch control signals $S_1$~$S_4$. The trim fuse circuit 200 comprises four fuse sets 211, 212, 213 and 214, a trim control module 220 and a current control module 230.

The current control module 230 comprises a transistor $Q_1$ and a constant current source $I_{REF}$. The current control module 230 is utilized to form current mirrors with the transistors $Q_{11}$, $Q_{21}$, $Q_{31}$ and $Q_{41}$ in the fuse sets 211, 212, 213 and 214 for duplicating currents with the same magnitude as the current from the constant current source $I_{REF}$. A first end (source) of the transistor $Q_1$ is electrically connected to a voltage source $V_{DD}$ (for example, 5 volt). A second end (drain) of the transistor $Q_1$ is electrically connected to the constant current source $I_{REF}$. A control end (gate) of the transistor $Q_1$ is electrically connected to the second end of the transistor $Q_1$ and the control ends of the transistors $Q_{11}$, $Q_{21}$, $Q_{31}$, and $Q_{41}$. The constant current source $I_{REF}$ is electrically connected between the second end of the transistor $Q_1$ and a voltage source $V_{SS}$ (for example, a ground end, 0 volt). The transistor $Q_1$ can be a P channel Metal Oxide Semiconductor (PMOS) transistor.

The fuse sets 211~214 are respectively utilized to provide the logic (voltage level) of the switch control signals $S_1$~$S_4$. That is, after the trim control module 220 trims, the fuse sets 211~214 generate the switch control signals $S_1$~$S_4$ with the fixed logic. The fuse sets 211~214 have the same structure, so only the fuse set 211 is illustrated and the description of the rest fuse sets is similar and will not be repeated again. The fuse set 211 comprises two transistors $Q_{11}$ and $Q_{12}$, a fuse $PF_1$ and an inverter $INV_1$. A first end (source) of the transistor $Q_{11}$ is electrically connected to the voltage source $V_{DD}$. A second end (drain) of the transistor $Q_{11}$ is electrically connected to a second end (drain) of the transistor $Q_{12}$. A control end (gate) of the transistor $Q_{11}$ is electrically connected to the control end of the transistor $Q_1$. In this way, the transistor $Q_{11}$ can form a current mirror with the transistor $Q_1$ for duplicating the current from the constant current source $I_{REF}$. A first end (source) (the node $N_1$) of the transistor $Q_{12}$ is electrically connected to the resistor $R_{COM}$ and the common trim conducting pad of the trim control module 220 through the fuse $PF_1$. A second end (drain) of the transistor $Q_{12}$ is electrically connected to a second end of the transistor $Q_{11}$. A control end (gate) of the transistor $Q_{12}$ is electrically connected to the second end of the transistor $Q_{12}$. Thus, the transistor $Q_{12}$ is utilized as a diode. The input end of the inverter $INV_1$ is electrically connected to the node $N_1$. The output end of the inverter $INV_1$ outputs the switch control signal $S_1$ according to the voltage level on the input end of the invert $INV_1$ (the voltage level on the node $N_1$). The inverter $INV_1$ can be designed that when the voltage level on the input end of the inverter $INV_1$ is higher than 2 volts (the voltage level on the node $N_1$ higher than 2 volts), the output (switch control signal $S_1$) of the inverter $INV_1$ is logic "0", and when the voltage level on the input end of the inverter $INV_1$ is lower than 0.5 volt (the voltage level on the node $N_1$ lower than 0.5 volt), the output (switch control signal $S_1$) of the inverter $INV_1$ is logic "1".

In addition, the transistor $Q_{11}$ can be a PMOS transistor and the transistor $Q_{12}$ can be an N channel Metal Oxide Semiconductor (NMOS) transistor. The fuse $PF_1$ can be a poly-silicon fuse with an impedance about 99 ohms.

The trim control module 220 comprises four trim conducting pads $P_{T1}$, $P_{T2}$, $P_{T3}$ and $P_{T4}$, a common trim conducting pad $P_{COM}$ and a resistor $R_{COM}$. The trim conducting pads $P_{T1}$, $P_{T2}$, $P_{T3}$ and $P_{T4}$ are respectively electrically connected to the nodes $N_1$, $N_2$, $N_3$ and $N_4$. The common trim conducting pad $P_{COM}$ is electrically connected to all the fuses $PF_1$~$PF_4$. The resistor $R_{COM}$ is electrically connected between all the fuses $PF_1$~$PF_4$ and the voltage source $V_{SS}$ and is utilized as a pull-low resistor. The impedances of the fuses $PF_1$~$PF_4$ limit the currents passing through the fuses $PF_1$~$PF_4$ during the prediction phase to prevent the fuses $PF_1$~$PF_4$ from being burned out.

During the prediction phase, the trim conducting pads $P_{T1}$~$P_{T4}$ are utilized to receive the trim prediction voltages (for example, 2 volts or 0 volt) and transmit the received trim prediction voltages to the corresponding inverters for predicting if the generated logic of the switch control signals are as required. During the trim phase, the trim conducting pads $P_{T1}$~$P_{T4}$ are utilized to receive the trim set voltage (for example, 5 volt) and the common trim conducting pad $P_{ow}$ is utilized to receive the trim common voltage (for example, 0 volt) for trimming the fuses as desired.

For example, during the prediction phase, the trim conducting pad $P_{T1}$ receives a voltage with 2 volts and transmits to the node $N_1$ (the input end of the inverter $INV_1$). As a result, the switch control signal $S_1$ outputted from the inverter $INV_1$ during the prediction phase is logic "0". On the contrary, during the prediction phase, the trim conducting pad $P_{T1}$ receives a voltage with 0 volt and transmits to the node $N_1$ (the input end of the inverter $INV_1$). As a result, the switch control signal $S_1$ outputted from the inverter $INV_1$ during the prediction phase is logic "1".

After the prediction phase, if the switch control signal is determined to be logic "0", during the trim phase, the trim conducting pad $P_{T1}$ receives a trim set voltage with 5 volts and the common trim conducting pad $P_{COM}$ receives a trim common voltage with 0 volt. Consequently, the voltage drop across the fuse $PF_1$ is 5 volts so that a large current passes through and burns out the fuse $PF_1$ and the connection established by the fuse $PF_1$ is broken (open-circuited). In such condition, the node $N_1$ is not electrically connected to the voltage source $V_{SS}$ through the fuse $PF_1$ and the resistor $R_{COM}$ and does not keep at a low level. Instead, the node $N_1$ is electrically connected to the voltage source $V_{DD}$ through the transistors $Q_{11}$ and $Q_{12}$ so as to keep at a high voltage level (higher than 2 volts). Thus, the inverter $INV_1$ outputs the switch control signal $S_1$ with the logic "0".

On the contrary, after the prediction phase, if the switch control signal is determined to be logic "1", during the trim phase, the trim conducting pad $P_{T1}$ does not receive the trim set voltage with 5 volts. That is, the voltage on the trim conducting pad $PF_1$ is floating. The common trim conducting pad $P_{COM}$ still receives the trim common voltage with 0 volt. Consequently, there is no voltage drop across the fuse $PF_1$ so that no large current passes through the fuse $PF_1$ and the fuse $PF_1$ is not burned out. In such condition, the node $N_1$ is electrically connected to the voltage source $V_{SS}$ through the fuse $PF_1$ and the resistor $R_{COM}$ so as to keep at a low voltage level (lower than 0.5 volt). Thus, the inverter $INV_1$ outputs the switch control signal $S_1$ with the logic "1".

Please refer to FIG. 3. FIG. 3 is a diagram illustrating the conventional trim fuse circuit 200 during the prediction phase. During the prediction phase, different trim prediction voltages (for example, 0 volt or 2 volt) can be set on the trim conducting pads $P_{T1}$~$P_{T4}$ so that the inverters $INV_1$~$INV_4$ generate the corresponding switch control signals $S_1$-$S_4$ accordingly. In such condition, the reference voltage $V_{REF}$ is obtained from the reference voltage circuit 100 controlled by the switch control signals $S_1$~$S_4$ which are determined in the prediction phase. If the obtained reference voltage $V_{REF}$ is as desired, then the trim fuse circuit 200 enters the trim phase to trim the fuses to be trimmed; if not, different trim prediction voltages are set on the trim conducting pads $P_{T1}$~$P_{T4}$ over and over again so that the inverters $INV_1$~$INV_4$ generate the corresponding switch control signals $S_1$~$S_4$ accordingly until the obtained reference voltage $V_{REF}$ is as desired. As shown in FIG. 3, the trim conducting pads $P_{T1}$, $P_{T2}$, $P_{T3}$ and $P_{T4}$ respectively receive the trim prediction voltages with 2, 0, 2, and 0 volts. As a result, the switch control signals $S_1$~$S_4$ generated from $INV_1$, $INV_2$, $INV_3$, and $INV_4$ are [0101]. According to the logic of the switch control signals $S_1$~$S_4$ ([0101]), the voltage reference circuit 100 generates the reference voltage $V_{REF}$ with 3 volts ($V_{REF}=1\times(R_1+R_3+R_5)=1\times(1+1+1)=3$). If the required voltage level of the reference voltage is 3 volts, then the trim fuse circuit 200 enters the trim phase for trimming the fuses required to be burned out.

Please refer to FIG. 4. FIG. 4 is a diagram illustrating the conventional trim fuse circuit 200 during the trim phase. According to the FIG. 3, it is known that the switch control signals $S_1$~$S_4$ are [0101] eventually. That is, the fuses $PF_1$ and $PF_3$ are required to be trimmed (burned out) so that the connections established by the fuses $PF_1$ and $PF_3$ are broken (open-circuited). In this way, the nodes $N_1$ and $N_3$ keep at the high voltage level respectively by being electrically connected to the voltage source $V_{DD}$ through the transistors $Q_{12}$ and $Q_{32}$. Therefore, the inverters $INV_1$ and $INV_3$ output the switch control signals $S_1$ and $S_3$ with logic "0". The fuses $PF_2$ and $PF_4$ are not required to be trimmed (burned out). Thus, the nodes $N_2$ and $N_4$ still keep at the low voltage respectively by being electrically connected to the voltage source $V_{SS}$ through the fuses $PF_2$, $PF_4$ and the resistor $R_{COM}$ so that the inverters $INV_2$ and $INV_4$ output the switch control signals $S_2$ and $S_4$ with logic "1". Consequently, during the trim phase, for burning out the fuses $PF_1$ and $PF_3$, the received voltages on trim conducting pads $P_{T1}$ and $P_{T3}$ are required to be 5 volts and the received voltage on the common conducting pad $P_{COM}$ are required to be 0 volt so that the large currents pass through and burn out the fuses $PF_1$ and $PF_3$.

However, the trim conducting pads $P_{T1}$~$P_{T4}$ are required to use probe-contacting for receiving the trim prediction voltages or the trim set voltages. As a result, the areas of the trim conducting pads $P_{T1}$~$P_{T4}$ must be large enough. In such condition, if the trim conducting pads $P_{T1}$~$P_{T4}$ are disposed in the chips on the wafer, the available area in the chips decreases extremely. Consequently, by means of the conventional technology, the trim conducting pads $P_{T1}$~$P_{T4}$ are disposed on the scribe lines of the wafer for increasing the available area in the chips.

Please refer to FIG. 5. FIG. 5 is a diagram illustrating the trim conducting pads being disposed on the scribe line when a wafer is being scribed. As shown in FIG. 5, because the trim conducting pads $P_{T1}$~$P_{T4}$ are disposed on the scribe line of the wafer, when the wafer is scribed to generate chips, the trim conducting pads $P_{T1}$~$P_{T4}$ are scribed as well. In general, all of the trim conducting pads are made in metal. Since the metal has good malleability, the trim conducting pads $P_{T1}$~$P_{T4}$ may be stretched because of being scribed, and therefore contact the substrate of the wafer. Generally speaking, the substrate of the P-type substrate wafer is utilized to be the common voltage source $V_{SS}$ (ground end, 0 volt) and the substrate of the N-type substrate wafer is utilized to be the common voltage source $V_{DD}$ (for example, 5 volts). Thus, after being scribed, the trim conducting pads $P_{T1}$~$P_{T4}$ are possible to receive the voltage provided by the voltage sources $V_{DD}$ or $V_{SS}$ and the switch control signals are affected so that the actual reference voltage is different from expected.

Please refer to FIG. 6. FIG. 6 is a diagram illustrating that the trim conducting pad contacts the substrate of the wafer, causing the incorrect switch control signals. The fuse set 212 is illustrated in FIG. 6. The rest fuse sets can be derived and not to be repeated again. Suppose that the substrate of the wafer shown in FIG. 6 is the N-type substrate. After the prediction phase shown in FIG. 3 and the trim phase shown in FIG. 4, the fuse $PF_2$ of the fuse set 212 is determined not to be trimmed (burned out) so that the voltage on the node $N_2$ is pulled to be at the low voltage level by being electrically connected to the voltage source $V_{SS}$ through the resistor $R_{COM}$. Hence, the switch control signal $S_2$ outputted from the inverter $INV_2$ is logic "1". However, after being scribed, the trim conducting pad $P_{T2}$ is stretched to be electrically connected to the N-type substrate. Therefore, the trim conducting pad $P_{T2}$ receives the voltage provided by the voltage source $V_{DD}$ (for example, 5 volts) and transmits the received voltage to the node $N_2$. In this way, the voltage on the node $N_2$ is raised up to the high voltage level due to the voltage source $V_{DD}$. It means that the switch control signal $S_2$ outputted from the inverter $INV_2$ becomes logic "0" and not to be the required logic "1". In such condition, the obtained reference voltage is not as the same as expected, which causes inconvenience.

SUMMARY OF THE INVENTION

The present invention provides a trim fuse circuit capable of disposing trim conducting pads on a scribe line of a wafer. The trim fuse circuit comprises a current control module, a fuse set, and a trim control module. The current control module comprises a transistor and a constant current source. The transistor comprises a first end electrically connected to a first voltage source, a second end and a control end. The constant current source is electrically connected to the second end of the transistor of the current control module for generating a reference current. The fuse set comprises a first transistor, a second transistor, a fuse, and an inverter. The first transistor comprises a first end electrically connected to a second voltage source, a second end and a control end electrically connected to the second end of the first transistor of the fuse set. The second transistor comprises a first end electrically connected to the first voltage source, a second end and a control end electrically connected to the control end of the transistor of the current control module. The second transistor of the fuse set and the transistor of the current control module form a current mirror for generating the reference current from the second end of the second transistor of the fuse set. The fuse comprises a first end electrically connected to the second end of the first transistor of the fuse set, and a second end electrically connected to the second end of the second transistor of the fuse set. The inverter comprises an input end electrically connected to the second end of the fuse and an output end for generating an information signal. When voltage level on the input end of the inverter is higher than a first predetermined voltage level, the information signal is at a low voltage level. When voltage level on the input end of the inverter is lower than a second predetermined voltage level, the information signal is at a high voltage level. The trim control module comprises a trim conducting pad, a common trim conducting pad, and a switch. The trim conducting pad is disposed on the scribe line of the wafer. The switch comprises a first end electrically connected to the input end of the inverter of the fuse set, a second end electrically connected to the first voltage source, and a control end electrically connected to the common trim conducting pad. The first end of the switch is electrically connected to the second end of the switch according to voltage on the common trim conducting pad.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " Also, the term "electrically connect" is intended to mean either an indirect or direct electrical connection. Accordingly, if one device is electrically connected to another device, that connection may be through a direct electrical connection, or through an indirect electrical connection via other devices and connections.

Figure 1:
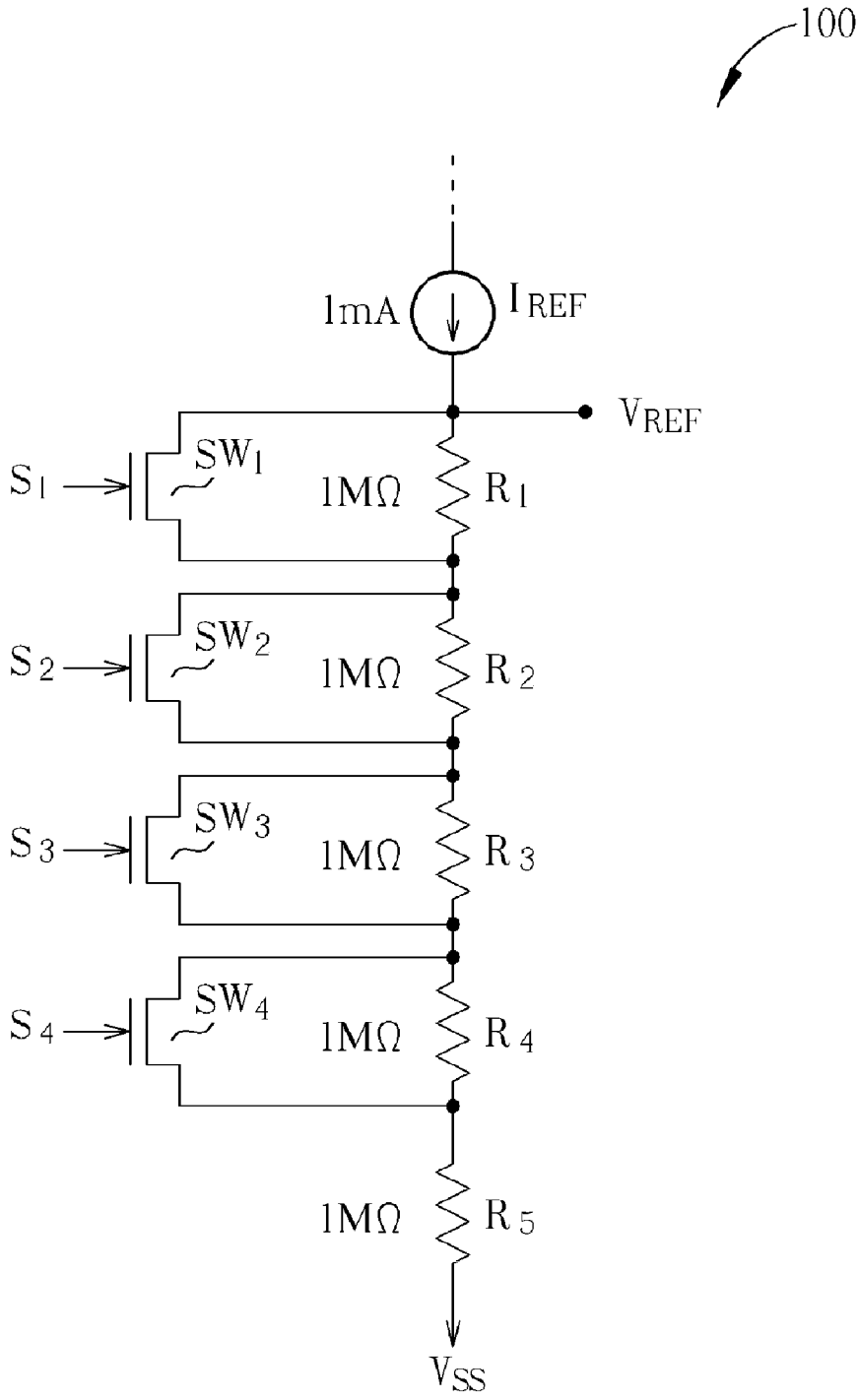
FIG. 1 PRIOR ART
FIG. 1 is a diagram illustrating a voltage reference circuit.
Figure 2:
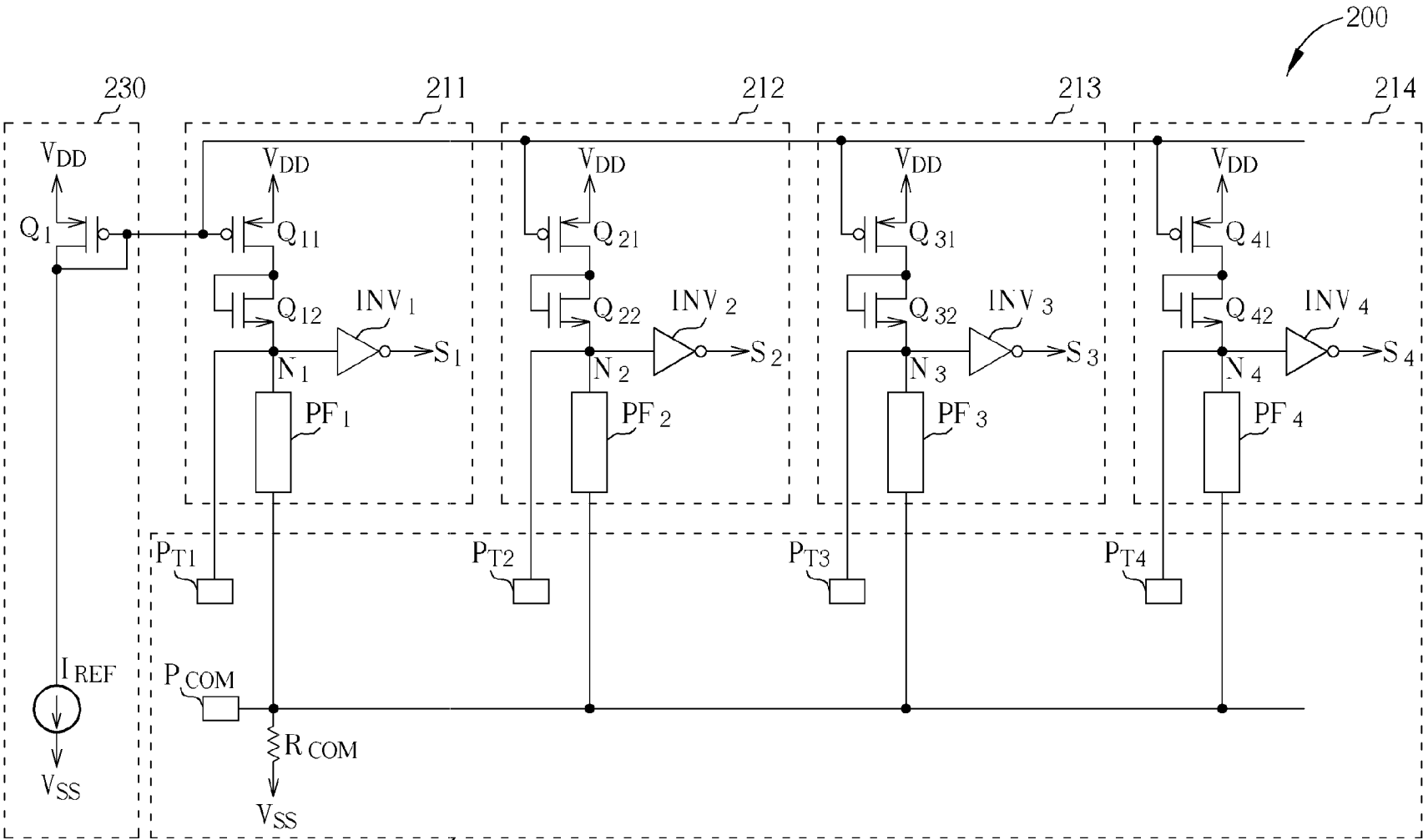
FIG. 2 PRIOR ART
FIG. 2 is a diagram illustrating a conventional trim fuse circuit.
Figure 3:
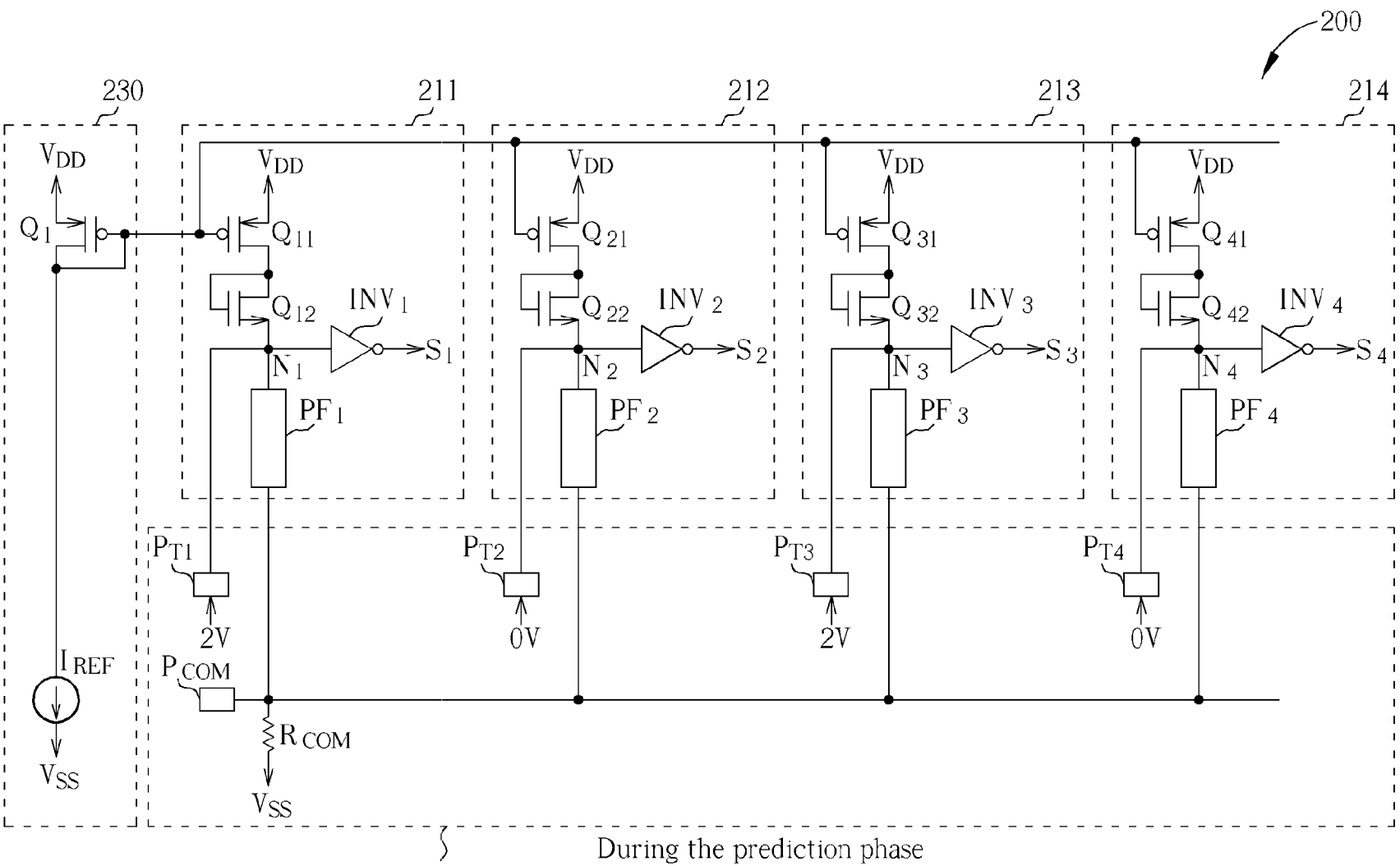
FIG. 3 PRIOR ART
FIG. 3 is a diagram illustrating the conventional trim fuse circuit during the prediction phase.
Figure 4:
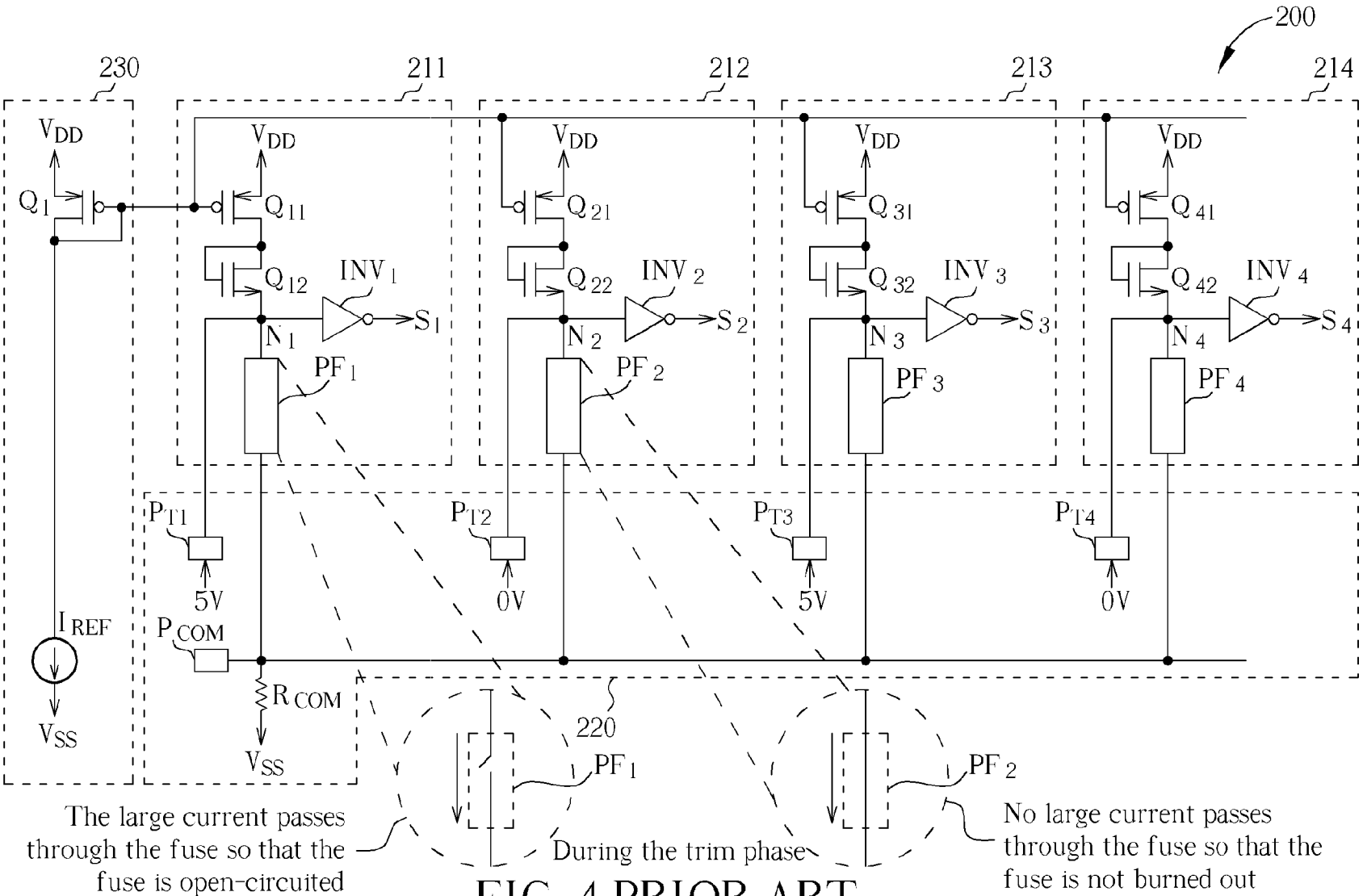
FIG. 4 PRIOR ART
FIG. 4 is a diagram illustrating the conventional trim fuse circuit during the trim phase.
Figure 5:
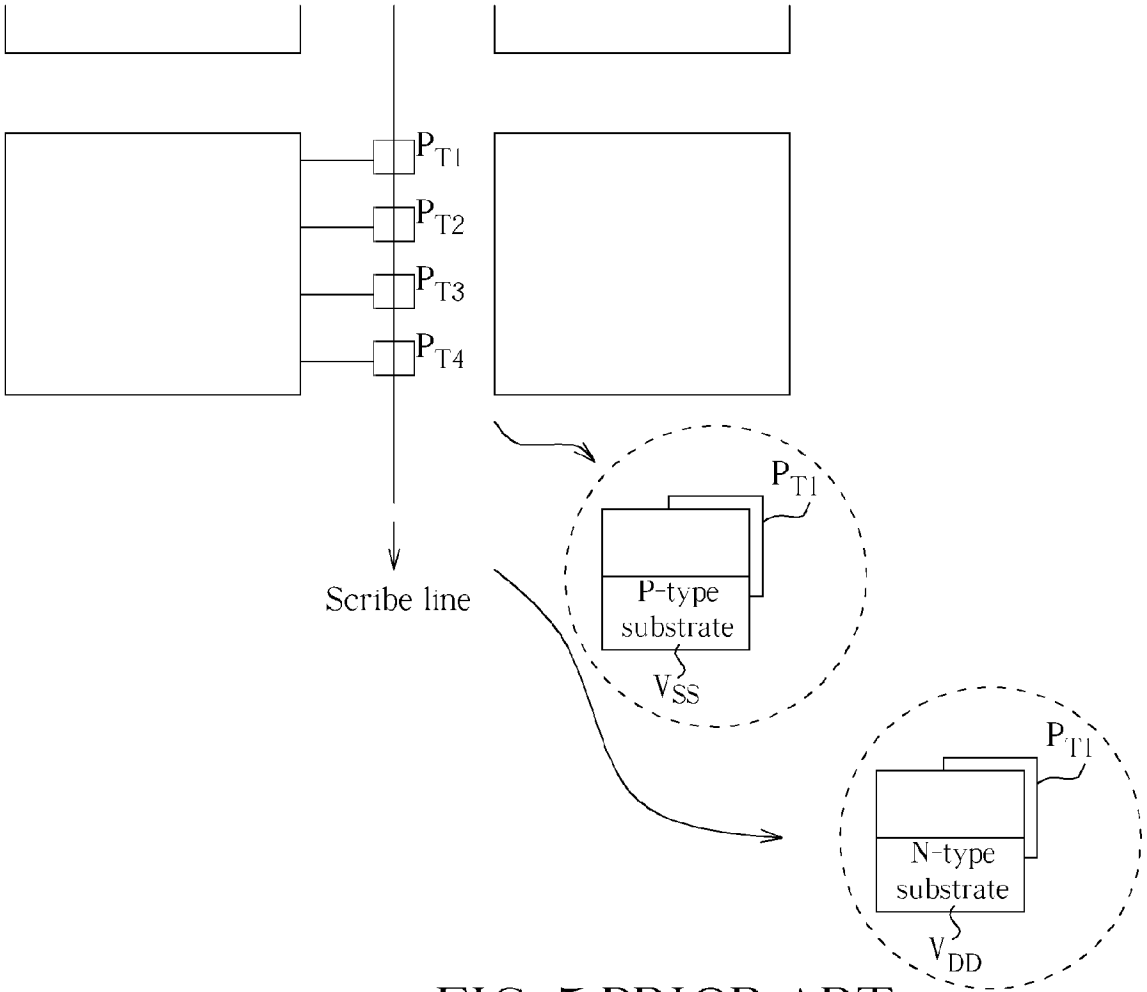
FIG. 5 PRIOR ART
FIG. 5 is a diagram illustrating the trim conducting pads being disposed on the scribe line.
Figure 6:
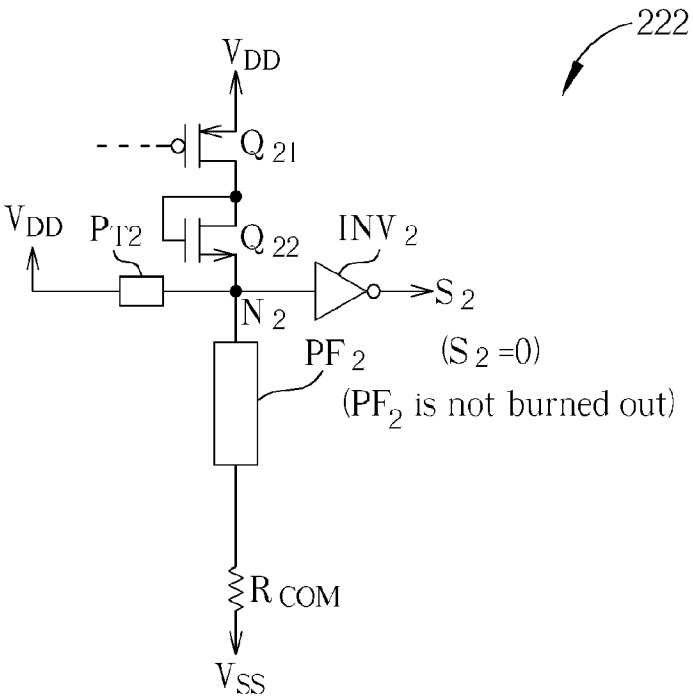
FIG. 6 PRIOR ART
FIG. 6 is a diagram illustrating that the trim conducting pad contacts the substrate of the wafer.
Figure 7:
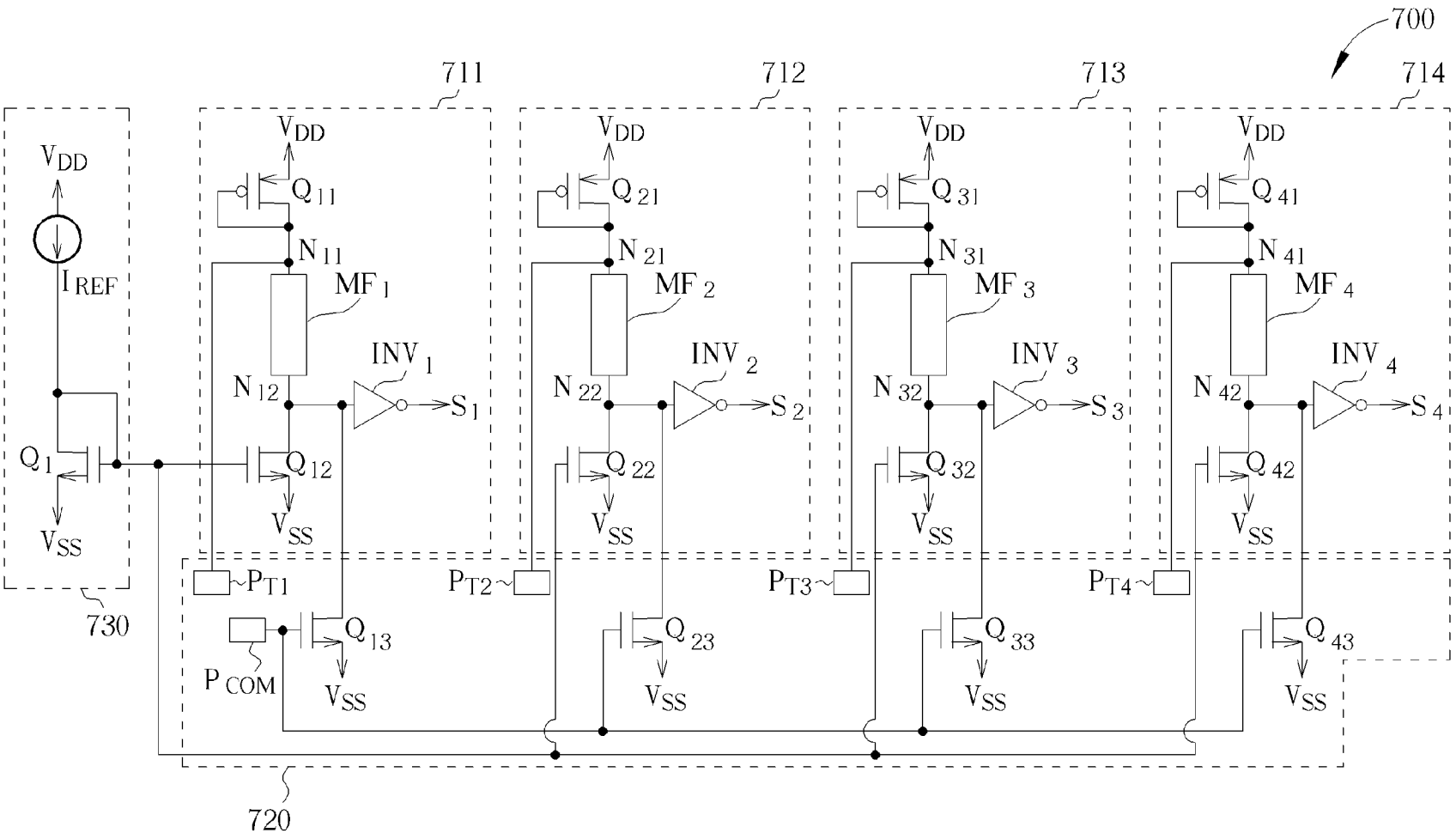
FIG. 7 is a diagram illustrating a trim fuse circuit according to a first embodiment of the present invention.

Please refer to FIG. 7. FIG. 7 is a diagram illustrating a trim fuse circuit 700 according to a first embodiment of the present invention. The trim fuse circuit 700 is utilized for generating the switch control signals $S_1$~$S_4$. The trim fuse circuit 700 is utilized in the fabrication of the N-type substrate wafer. The trim fuse circuit 700 can be set by users for controlling the logic (voltage level) of the switch control signals $S_1$~$S_4$. However, the switch control signals $S_1$~$S_4$ of the trim fuse circuit 700 are not limited to be utilized in the reference circuit 100. That is, the switch control signals can be treated as various information signals according to the design. The trim fuse circuit 700 comprises four fuse sets 711, 712, 713, 714, a trim control module 720, and a current control module 730.

The current control module 730 comprises a transistor $Q_1$ and a constant current source $I_{REF}$. The constant current source $I_{REF}$ is utilized to form the current mirrors with the transistors $Q_{12}$, $Q_{22}$, $Q_{32}$ and $Q_{42}$ for duplicating the currents with the same magnitude as the current of the constant current source $I_{REF}$. A first end (source) of the transistor $Q_1$ is electrically connected to a voltage source $V_{SS}$ (for example, a ground end, 0 volt). A second end (drain) of the transistor $Q_1$ is electrically connected to the constant current source $I_{REF}$. A control end (gate) of the transistor $Q_1$ is electrically connected to the second end of the transistor $Q_1$ and the control ends of the transistors $Q_{12}$, $Q_{22}$, $Q_{32}$, and $Q_{42}$. The constant current source $I_{REF}$ is electrically connected to the second end of the transistor $Q_1$ and a voltage source $V_{DD}$ (for example, 5 volts). In the first embodiment of the present invention, the transistor $Q_1$ is an N channel Metal Oxide Semiconductor (NMOS) transistor.

The fuse sets 711~714 are respectively utilized for providing the logic (voltage level) of the switch control signals $S_1$~$S_4$. It means that after the trim phase of the trim control module 720, the fuse sets 711~714 generate the switch control signals $S_1$~$S_4$ with the fixed logic. The fuse sets 711~714 have the same structures. The fuse set 711 is illustrated in the following description and the rest fuse sets can be derived and will not be repeated again. The fuse set 711 comprises two transistors $Q_{11}$ and $Q_{12}$, a fuse $MF_1$ and an inverter $INV_1$. A first end (source) of the transistor $Q_{12}$ is electrically connected to the voltage source $V_{SS}$. A second end (drain) (the node $N_{12}$) is electrically connected to a second end (drain) (the node $N_{11}$) of the transistor $Q_{11}$ through the fuse $MF_1$. A control end (gate) of the transistor $Q_{12}$ is electrically connected to the control end of the transistor $Q_1$. In such condition, the transistor $Q_{12}$ forms a current mirror with the transistor $Q_1$ for duplicating the current of the constant current source $I_{REF}$. A first end (source) of the transistor $Q_{11}$ is electrically connected to the voltage source $V_{DD}$. A second end (drain) of the transistor $Q_{11}$ is electrically connected to the second end of the transistor $Q_{12}$ through the fuse $MF_1$. A control end (gate) of the transistor $Q_{11}$ is electrically connected to the second end of the transistor $Q_{11}$. In this way, the transistor $Q_{11}$ is utilized as a diode (the gate and the source of the transistor $Q_{11}$ are electrically connected). The input end of the inverter $INV_1$ is electrically connected to the node $N_{12}$. The output end of the inverter $INV_1$ outputs the switch control signals $S_1$ according to the voltage on the input end of the inverter $INV_1$ (the voltage on the node $N_{12}$). The inverter $INV_1$ can be designed that when the voltage on the input end of the inverter $INV_1$ is higher than 2 volts (the voltage on the node $N_{12}$ is higher than 2 volts), the output of the inverter $INV_1$ (the switch control signal $S_1$) is logic "0", and when the voltage on the input end of the inverter $INV_1$ is lower than 0.5 volt (the voltage on the node $N_{12}$ is lower than 0.5 volt), the output of the inverter $INV_1$ (the switch control signal $S_1$) is logic "1".

Furthermore, in the fuse sets 711~714 of the first embodiment of the present invention, the transistors $Q_{11}$, $Q_{21}$, $Q_{31}$ and $Q_{41}$ are PMOS transistors, and the transistors $Q_{12}$, $Q_{22}$, $Q_{32}$ and $Q_{42}$ are NMOS transistors. The fuses $MF_1$, $MF_2$, $MF_3$ and $MF_4$ are metal fuses with the impedance about 0.1 ohm.

The trim control module 720 comprises four trim conducting pads $P_{T1}$, $P_{T2}$, $P_{T3}$ and $P_{T4}$, a common trim conducting pad $P_{COM}$ and four transistors $Q_{13}$, $Q_{23}$, $Q_{33}$ and $Q_{43}$. The transistors $Q_{13}$, $Q_{23}$, $Q_{33}$ and $Q_{43}$ corresponds to the fuse sets 711~714, respectively. The trim conducting pads $P_{T1}$, $P_{T2}$, $P_{T3}$ and $P_{T4}$ are respectively electrically connected to the nodes $N_{11}$ (a first end of the fuse $MF_1$), $N_{21}$ (a first end of the fuse $MF_2$), $N_{31}$ (a first end of the fuse $MF_3$) and $N_{41}$ (a first end of the fuse $MF_4$). The common trim conducting pad $P_{COM}$ is electrically connected to the control ends (gates) of the transistors $Q_{13}$~$Q_{43}$ for receiving a trim common voltage (for example, 5 volt) during the trim phase in order to turn on the transistors $Q_{13}$~$Q_{14}$ so as to trim the fuses required to be burned out. The transistors $Q_{13}$~$Q_{43}$ are connected to the corresponding fuses with the same manner, and therefore only the transistor $Q_{13}$ is illustrated as an example and the related description for the rest transistors will not be repeated again. A first end (source) of the transistor $Q_{13}$ is electrically connected to the voltage source $V_{SS}$ (ground end, 0 volt). A second end (drain) of the transistor $Q_{13}$ is electrically connected to the node $N_{12}$ (the input end of the inverter $INV_1$) (a second end of the fuse $MF_1$). A control end (gate) of the transistor $Q_{13}$ is electrically connected to the common trim conducting pad $P_{COM}$.

In addition, in the trim control module 720 of the first embodiment of the present invention, the transistors $Q_{13}$~$Q_{43}$ are NMOS transistors. The transistors $Q_{13}$~$Q_{43}$ are treated as the switches for electrically connecting the nodes $N_{12}$~$N_{42}$ to the voltage source $V_{SS}$ respectively.

During the prediction phase, the trim conducting pads $P_{T1}$~$P_{T4}$ are utilized to receive the trim prediction voltages (for example, 0 or 2 volts) and transmit to the corresponding inverters through the corresponding fuses for determining if the logic of the generated switch control signals are as required. During the trim phase, the trim conducting pads $P_{T1}$~$P_{T4}$ are utilized to receive the trim set voltages (for example, 5 volts) and the trim common conducting pads $P_{COM}$ is utilized to receive the trim common voltage (for example, 5 volts) for burning out the fuses as desired.

For example, during the prediction phase, the trim conducting pad $P_{T1}$ receives the trim prediction voltage with 2 volts and transmits the trim prediction voltage to the node $N_{12}$ (the input end of the inverter $INV_1$) through the node $N_{11}$ and the fuse $MF_1$. As a result, during the prediction phase, the switch control signal $S_1$ outputted from the inverter $INV_1$ is logic "0". On the contrary, during the prediction phase, the trim conducting pad $P_{T1}$ receives the trim prediction voltage with 0 volt and transmits the trim prediction voltage to the node $N_{12}$ (the input end of the inverter $INV_1$) through the node $N_{11}$ and the fuse $MF_1$. As a result, during the prediction phase, the switch control signal $S_1$ outputted from the inverter $INV_1$ is logic "1".

After the prediction phase, if the user determines that the switch control signal $S_1$ is required to be the logic "0", the trim conducting pad $P_{T1}$ does not receive the trim set voltage with 5 volts during the trim phase. That is, the voltage on the trim conducting pad $P_{T1}$ is floating and the common trim conducting pad $P_{COM}$ receives the trim common voltage with 5 volts. Meanwhile, the transistor $Q_{13}$ is turned on by the trim common voltage with 5 volts on the common trim conducting pad $P_{COM}$ so that the second end of the fuse $MF_1$ is electrically connected to the voltage source $V_{SS}$. Therefore, there is no voltage drop with 5 volts across the fuse $MF_1$ so that no large current passes through the fuse $MF_1$ and the fuse $MF_1$ is not burned out. Since the current $I_{REF}$ is a current with relatively small magnitude, the node $N_{12}$ is electrically connected to the voltage source $V_{DD}$ through the fuse $MF_1$ and the transistor $Q_{11}$ and therefore the voltage on the node $N_{12}$ is kept at a high voltage level (higher than 2 volts). Consequently, the switch control signal $S_1$ outputted from the inverter $INV_1$ is logic "0".

On the contrary, after the prediction phase, if the user determines that the switch control signal $S_1$ is required to be the logic "1", the trim conducting pad $P_{T1}$ receives the trim set voltage with 5 volts and the common trim conducting pad $P_{COM}$ receives the trim common voltage with 5 volts during the trim phase. Meanwhile, the transistor $Q_{13}$ is turned on by the trim common voltage with 5 volts on the common trim conducting pad $P_{ow}$ so that the second end of the fuse $MF_1$ is electrically connected to the voltage source $V_{SS}$. Thus, the voltage on the first end of the fuse $MF_1$ (the node $N_{11}$) is 5 volts and the voltage on the second end of the fuse $MF_1$ (the node $N_{12}$) is 0 volt. That is, the voltage drop across the fuse $MF_1$ is 5 volts and the fuse $MF_1$ is burned out because of the large current passing through. In this way, the node $N_{12}$ is not able to electrically connect to the voltage source $V_{DD}$ through the fuse $MF_1$ and the transistor $Q_{11}$. Instead, the node $N_{12}$ is electrically connected to the voltage source $V_{SS}$ through the transistor $Q_{12}$ so as to keep the voltage on the node $N_{12}$ at a low voltage level (lower than 0.5 volt). Consequently, the switch control signal $S_1$ outputted from the inverter $INV_1$ is logic "1".

Figure 8:
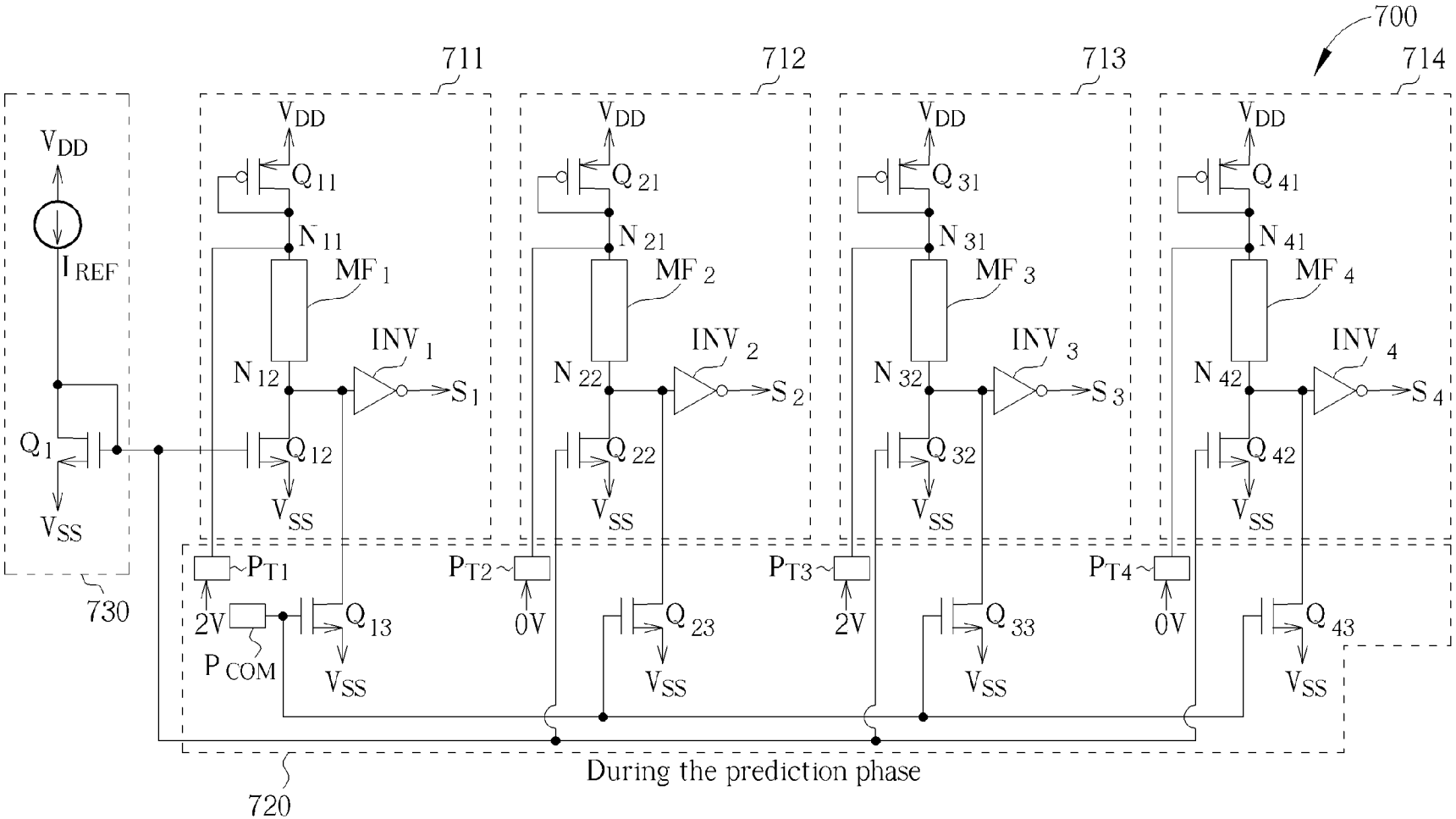
FIG. 8 is a diagram illustrating a trim fuse circuit during the prediction phase of the first embodiment of the present invention.

Please refer to FIG. 8. FIG. 8 is a diagram illustrating a trim fuse circuit 700 during the prediction phase of the first embodiment of the present invention. During the prediction phase, different trim prediction voltages (for example, 0 or 2 volts) are respectively given on the trim conducting pads $P_{T1}$~$P_{T4}$ and are respectively transmitted to the inverters $INV_1$~$INV_4$ through the nodes $N_{11}$~$N_{41}$, the fuses $MF_1$~$MF_4$, and the nodes $N_{12}$~$N_{42}$ so that the inverters $INV_1$~$INV_4$ generate the switch control signals $S_1$~$S_4$ with the corresponding logic. For example, the trim conducting pad $P_{T1}$ receives the trim prediction voltage with 2 volts and transmits the trim prediction voltage to the node $N_{12}$ (the input end of the inverter $INV_1$) through the node $N_{11}$ and the fuse $MF_1$ so that the inverter $INV_1$ outputs the switch control signal $S_1$ with the logic "0". In this way, the reference voltage $V_{REF}$ is obtained from the reference voltage circuit 100 according to the switch control signals $S_1$~$S_4$. If the obtained reference voltage $V_{REF}$ is as desired, then the trim fuse circuit 700 enters the trim phase to trim the fuses required to be burned out; if not, different trim prediction voltages are given on the trim conducting pads $PT_1$~$P_{T4}$ over and over again for the inverters $INV_1$~$INV_4$ generating the corresponding switch control signals $S_1$~$S_4$ accordingly until the obtained reference voltage $V_{REF}$ is as desired, and then the trim fuse circuit 700 is allowed to enter the trim phase to trim the fuses required to be burned out. As shown in FIG. 8, the trim conducting pads $P_{T1}$, $P_{T2}$, $P_{T3}$ and $P_{T4}$ respectively receive 2, 0, 2 and 0 volt. As a result, the switch control signals $S_1$~$S_4$ outputted from the inverters $INV_1$, $INV_2$, $INV_3$ and $INV_4$ are [0101]. According to the logic of the switch control signals $S_1$~$S_4$ ([0101]), the reference circuit 100 generates the reference voltage $V_{REF}$ with 3 volts ($V_{REF}=1\times(R_1+R_3+R_5)=1\times(1+1+1)=3$). If the desired reference voltage is 3 volts, then the trim fuse circuit 700 enters the trim phase to trim the fuses as required.

Figure 9:
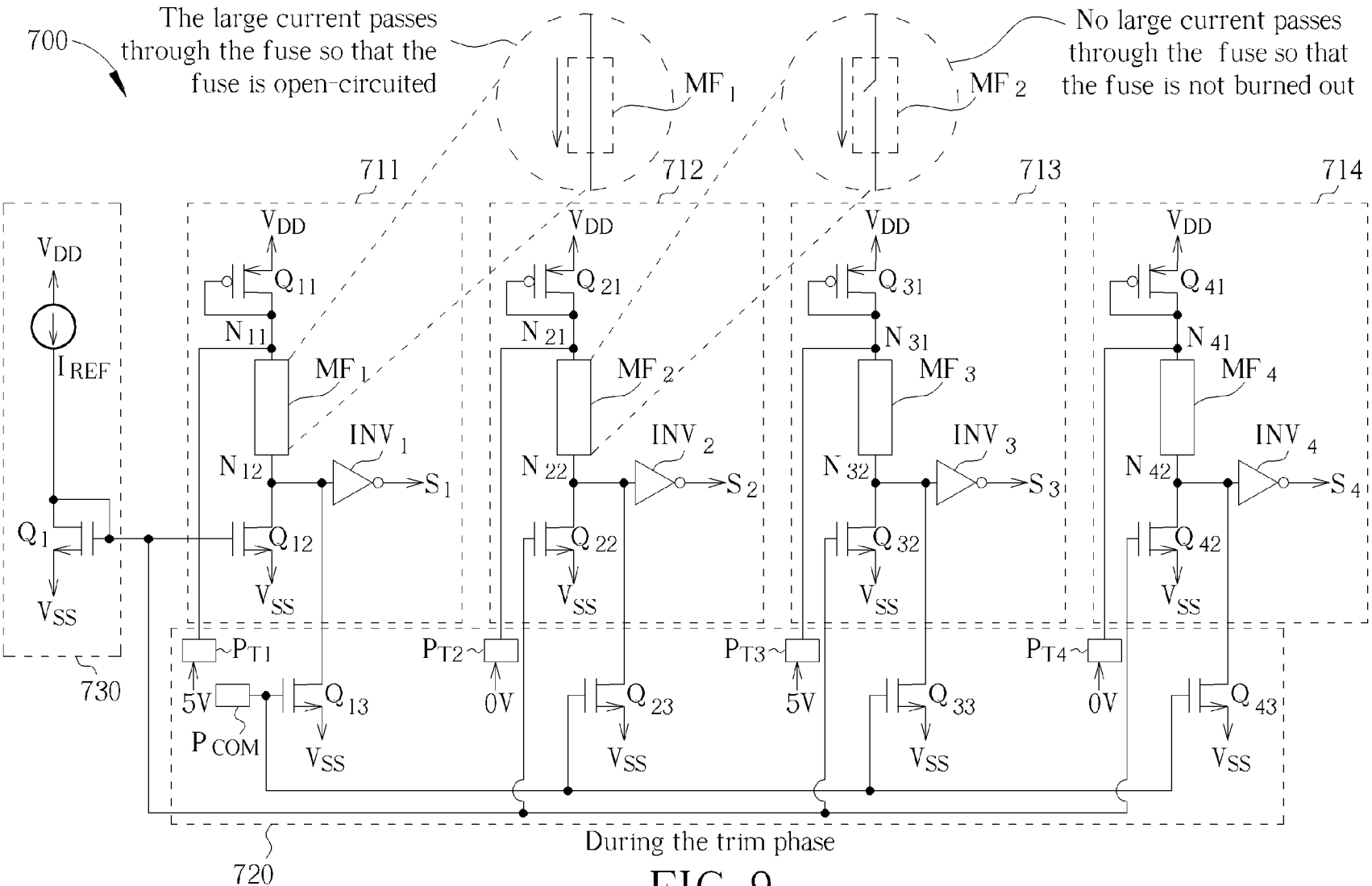
FIG. 9 is a diagram illustrating a trim fuse circuit during the trim phase of the first embodiment of the present invention.

Please refer to FIG. 9. FIG. 9 is a diagram illustrating a trim fuse circuit 700 during the trim phase of the first embodiment of the present invention. According to FIG. 8, it is known that the switch control signals $S_1$~$S_4$ are [0101] eventually. That is, the fuses $MF_2$ and $MF_4$ are required to be burned out so that the voltages on the nodes $N_{22}$, and $N_{42}$ respectively are kept at the low voltage level because of the nodes $N_{22}$ and $N_{42}$ are only respectively electrically connected to the voltage source $V_{SS}$ through the transistors $Q_{22}$ and $Q_{42}$. In this way, the inverters $INV_2$ and $INV_4$ generate the switch control signals $S_2$ and $S_4$ with the logic "1". The fuses $MF_1$ and $MF_3$ are required not to be burned out so that the voltages on the nodes $N_{12}$ and $N_{32}$ are kept at the high voltage level because of the nodes $N_{12}$ and $N_{32}$ are only electrically connected to the voltage source $V_{DD}$ through the transistor $Q_{11}$ and $Q_{31}$. In this way, the inverters $INV_1$ and $INV_3$ generate the switch control signals $S_1$ and $S_3$ with the logic "0". As a result, for burning out the fuses $MF_2$ and $MF_4$ during the trim phase, the common trim conducting pad $P_{T2}$ and $P_{T4}$ receives the trim common voltage with 5 volts (for turning on the transistors $Q_{23}$ and $Q_{43}$ so as to generate voltage drops on the fuses $MF_2$ and $MF_4$ with 5 volts) in order to burn out the fuses $MF_2$ and $MF_4$ with the large enough currents passing through.

In the trim fuse circuit 700 of the first embodiment of the present invention, the trim conducting pads $P_{T1}$~$P_{T4}$ are still disposed on the scribe lines of the wafer. Thus, the available area in the chips increases, and there is no risk of the incorrect switch control signals caused by contacting with the substrate. The detail is described as below.

Figure 10:
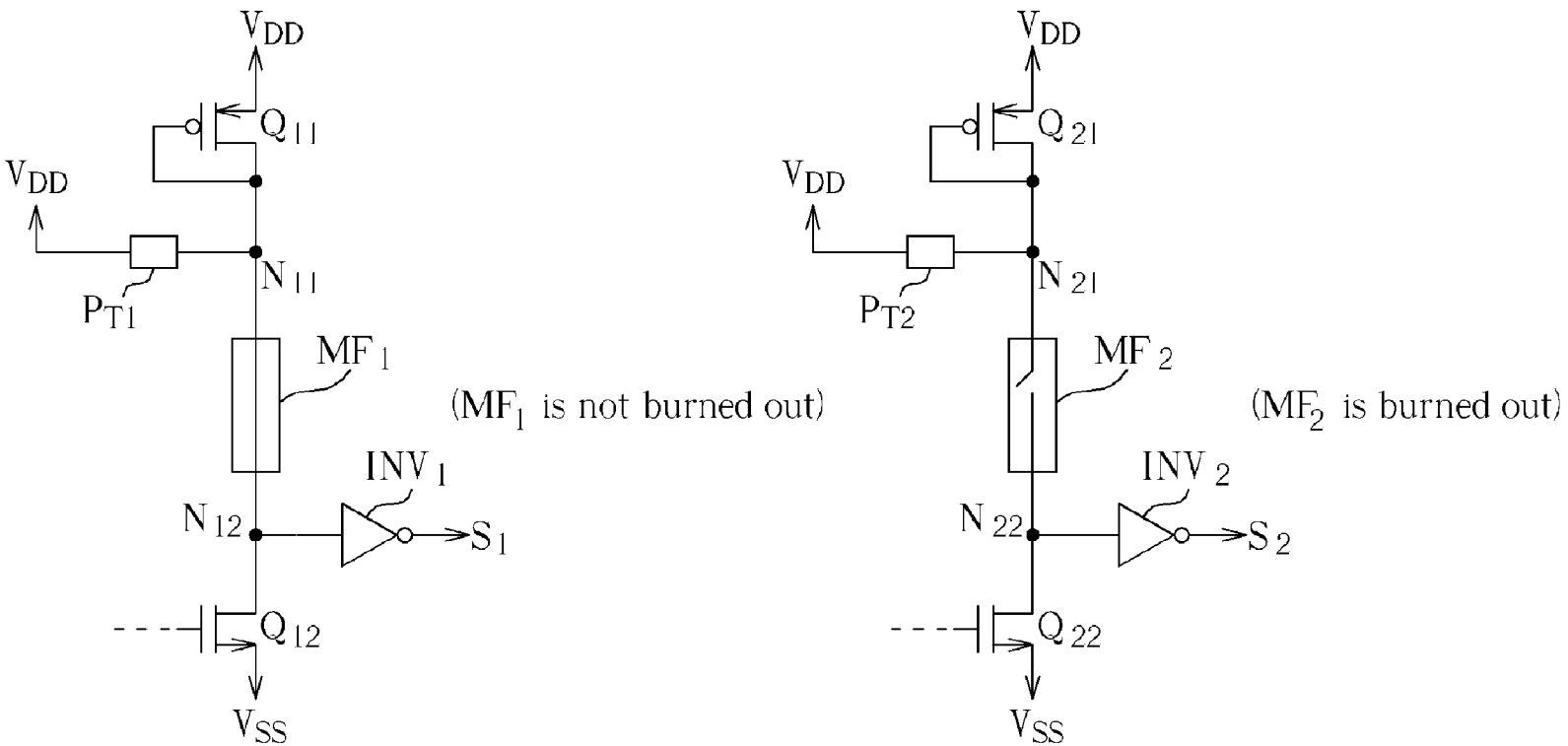
FIG. 10 is a diagram illustrating that there is still no incorrect switch control signal generated in the first embodiment of the present invention.

Please refer to FIG. 10. FIG. 10 is a diagram illustrating that, in the first embodiment of the present invention, even if the trim conducting pads of the trim fuse circuit 700 contacts with the substrate of the wafer, there is still no incorrect switch control signal generated. In FIG. 10, only the fuse sets 711 and 712 are illustrated as examples and the related description for the rest fuse sets will not be repeated again. As shown in FIG. 10, after the prediction phase in FIG. 8 and the trim phase in FIG. 9, the fuse $MF_1$ of the trim fuse set 711 is determined not to be trimmed. Since the transistor $Q_{12}$ is utilized for duplicating the current $I_{REF}$ and the current $I_{REF}$ is a very small current, the node $N_{12}$ is raised up to the high voltage level by the voltage source $V_{DD}$ through the fuse $MF_1$ and the transistor $Q_{11}$. In this way, the switch control signal $S_1$ outputted from the inverter $INV_1$ is logic "0". The fuse $MF_2$ of the trim fuse set 712 is determined to be burned out so that the node $N_{22}$ is pulled down to the low voltage level by the voltage source $V_{SS}$ through the transistor $Q_{22}$. Hence, the switch control signal $S_2$ outputted from the inverter $INV_2$ is logic "1". Although the trim conducting pads $P_{T1}$ and $P_{T2}$ are cut and is therefore stretched to electrically connect to the N-type substrate, the trim conducting pads $P_{T1}$ and $P_{T2}$ receive the voltage provided by the voltage source $V_{DD}$ (for example, 5 volts) and transmit the voltage respectively to the nodes $N_{11}$ and $N_{21}$. However, in the fuse set 711 after the trim phase, the voltage on the node $N_{11}$ is kept at the high voltage level due to the voltage source $V_{DD}$ through the fuse $MF_1$ and the transistor $Q_{11}$. In spite of the trim conducting pad $P_{T1}$ transmitting the voltage provided by the voltage source $V_{DD}$ from the N-type substrate, the voltage level of the node $N_{12}$ is still not affected so much and the inverter $INV_1$ does not generate the incorrect output. In the fuse set 712 after the trim phase, the voltage on the node $N_{22}$ is kept at the low voltage level due to the voltage source $V_{SS}$ through the transistor $Q_{12}$. Meanwhile, the fuse $MF_2$ is trimmed to be open-circuited. In spite of the trim conducting pad $P_{T2}$ transmitting the voltage provided by the voltage source $V_{DD}$ from the N-type substrate, the voltage provided by the voltage source $V_{DD}$ is still not transmitted to the node $N_{22}$ (because the fuse $MF_2$ is burned out). Thus, the voltage on the node $N_{22}$ is still not affected and the inverter $INV_2$ does not generate the incorrect output. Consequently, by utilizing the trim fuse circuit provided by the first embodiment of the present invention, the reference voltage obtained after the N-type wafer is scribed is the same as expected without being affected by the stretched trim conducting pads connecting to the N-type substrate.

Figure 11:
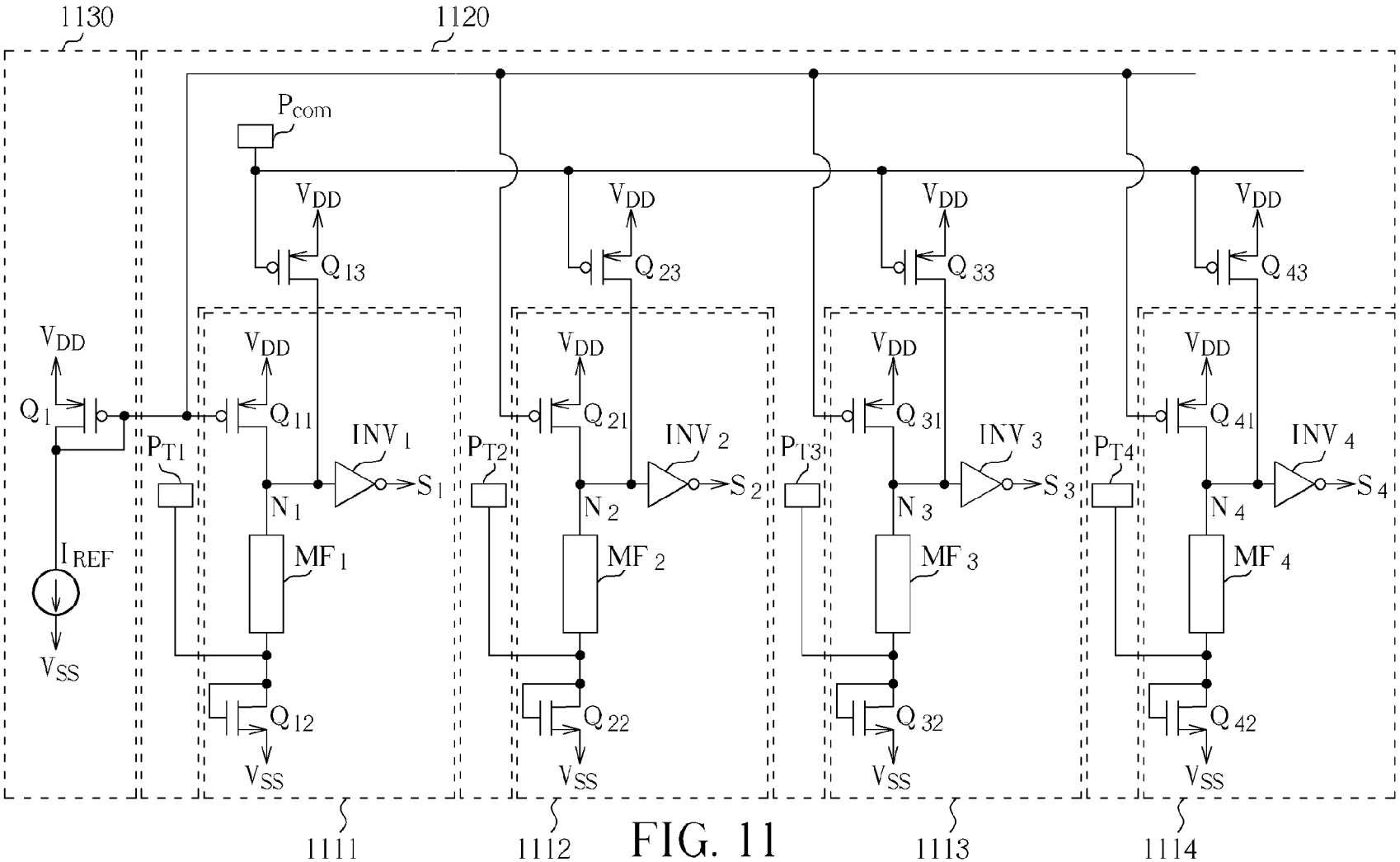
FIG. 11 is a diagram illustrating a trim fuse circuit of a second embodiment of the present invention.

Please refer to FIG. 11. FIG. 11 is a diagram illustrating a trim fuse circuit 1100 of a second embodiment of the present invention. The trim fuse circuit 1100 is utilized for generating switch control signals $S_1$~$S_4$. Different from the fuse circuit 700, the fuse circuit 1100 is utilized in the fabrication of the P-type substrate wafer. The trim fuse circuit 1100 is set for controlling the logic (voltage level) of the switch control signals $S_1$~$S_4$. The trim fuse circuit 1100 comprises four fuse sets 1111, 1112, 1113 and 1114, a trim control module 1120 and a current control module 1130. The structure, function and operation principle of the trim fuse circuit 1100 are the same or similar with the trim fuse circuit 700 and will not be repeated again for brevity.

In summary, the trim fuse circuits of different embodiments of the present invention are utilized according to the type of the wafer fabrication. In this way, when the trim conducting pads are disposed on the scribe lines of the wafer, there is no risk of the incorrect action caused by the trim conducting pads cut and stretched by the scriber, which provides convenience.

Those skilled in the art will readily observe that numerous modifications and alterations of the device and method may be made while retaining the teachings of the invention.

What is claimed is:

1. A trim fuse circuit capable of disposing trim conducting pads on a scribe line of a wafer, the trim fuse circuit comprising:

a current control module, comprising:

a transistor, comprising:

a first end, electrically connected to a first voltage source;

a second end; and a control end; and a constant current source, electrically connected to the second end of the transistor of the current control module for generating a reference current;

a fuse set, comprising:

a first transistor, comprising:

a first end, electrically connected to a second voltage source;

a second end; and a control end, electrically connected to the second end of the first transistor of the fuse set;

a second transistor, comprising:

a first end, electrically connected to the first voltage source;

a second end; and a control end, electrically connected to the control end of the transistor of the current control module;

wherein the second transistor of the fuse set and the transistor of the current control module form a current mirror for generating the reference current from the second end of the second transistor of the fuse set;

a fuse, comprising:

a first end, electrically connected to the second end of the first transistor of the fuse set; and a second end, electrically connected to the second end of the second transistor of the fuse set; and an inverter, comprising:

an input end, electrically connected to the second end of the fuse; and an output end for generating an information signal;

wherein when voltage level on the input end of the inverter is higher than a first predetermined voltage level, the information signal is at a low voltage level, and when the voltage level on the input end of the inverter is lower than a second predetermined voltage level, the information signal is at a high voltage level; and a trim control module, comprising:

a trim conducting pad, disposed on the scribe line of the wafer;

a common trim conducting pad; and a switch, comprising:

a first end, electrically connected to the input end of the inverter of the fuse set;

a second end, electrically connected to the first voltage source; and a control end, electrically connected to the common trim conducting pad;

wherein the first end of the switch is electrically connected to the second end of the switch according to voltage on the common trim conducting pad.

2. The trim fuse circuit of claim 1, wherein the first predetermined voltage level and the second predetermined voltage level are between a third voltage level provided by the first voltage source and a fourth voltage level provided by the second voltage source.

3. The trim fuse circuit of claim 2, wherein the first predetermined voltage level is lower than the fourth voltage level and the second predetermined voltage level is higher the third voltage level.

4. The trim fuse circuit of claim 3, wherein when the trim fuse circuit is during a prediction phase, the trim conducting pad receives a prediction voltage for predicting the voltage level of the information signal outputted from the inverter.

5. The trim fuse circuit of claim 4, wherein voltage level of the prediction voltage is between the first predetermined voltage level and the fourth voltage level.

6. The trim fuse circuit of claim 4, wherein when the trim fuse circuit is during a trim phase, the common trim conducting pad receives a trim common voltage to turn on the switch for electrically connecting the first end of the switch to the second end of the switch, and the trim conducting pad receives a trim set voltage for trimming the fuse according to the predicted information signal of the trim fuse circuit during the prediction phase.

7. The trim fuse circuit of claim 1, wherein the switch is a transistor.

8. The trim fuse circuit of claim 7, wherein when the wafer is an N-type substrate wafer, the transistor of the current control module is an N channel Metal Oxide Semiconductor (NMOS) transistor, the first transistor of the fuse set is a P channel Metal Oxide Semiconductor (PMOS) transistor, the second transistor of the fuse set is an NMOS transistor, and the switch of the trim control module is an NMOS transistor.

9. The trim fuse circuit of claim 7, wherein when the wafer is a P-type substrate wafer, the transistor of the current control module is a PMOS transistor, the first transistor of the fuse set is an NMOS transistor, the second transistor of the fuse set is a PMOS transistor, and the switch of the trim control module is a PMOS transistor.

10. The trim fuse circuit of claim 1, wherein the information signal is utilized to control a reference voltage circuit for generating a reference voltage.

11. The trim fuse circuit of claim 1, wherein the fuse is a metal fuse.

* * * * *